US007121424B2

(12) United States Patent
Lisenbee et al.

(10) Patent No.: US 7,121,424 B2
(45) Date of Patent: Oct. 17, 2006

(54) CLOSED WALL STRUCTURE MOUNTED ON A GROOVED BASE

(76) Inventors: Henry C. Lisenbee, 19452 Beckonridge La., Huntington Beach, CA (US) 92648; Thomas Charles Weiss, 1545 Vandagriff Way, Corona, CA (US) 92883; JoDee Jensen Smith, 7839 E. Briarwood Rd., Orange, CA (US) 92869; James Patrick Sullivan, 7839 E. Briarwood Rd., Orange, CA (US) 92869

( * ) Notice: Subject to any disclaimer, the term of this patent is extended or adjusted under 35 U.S.C. 154(b) by 65 days.

(21) Appl. No.: 10/323,482

(22) Filed: Dec. 18, 2002

(65) Prior Publication Data

US 2004/0118843 A1 Jun. 24, 2004

(51) Int. Cl.
*B65D 6/28* (2006.01)
*B65D 8/04* (2006.01)
*B65D 8/06* (2006.01)

(52) U.S. Cl. ..... 220/617; 220/4.09

(58) Field of Classification Search ..... 220/617, 220/618, 621, 615, 629, 625, 4.01, 4.08, 220/4.09, 4.28, 4.31, 610, 623, 4.32, 4.34, 220/23.2, 23.6, 6; 52/249, 239.1, 293.2, 52/592.6, 604; 312/107; 428/61, 66.7, 83, 428/88; 248/345.1, 346.3, 346.5
See application file for complete search history.

(56) References Cited

U.S. PATENT DOCUMENTS 1,108,937 A * 9/1914 Snyder ..... 220/617
2,499,156 A 2/1950 Paolella
D201,536 S 6/1965 Jonas
3,339,540 A 9/1967 Kreider
3,557,770 A 1/1971 Szentkuti
3,913,774 A * 10/1975 Vajtay ..... 220/4.01
4,402,397 A * 9/1983 Spence ..... 220/4.28
5,022,527 A * 6/1991 Braeutigam ..... 206/522
5,186,161 A 2/1993 Shumock
5,596,980 A 1/1997 Whalen et al.
6,024,085 A 2/2000 Hodge et al.
6,050,256 A 4/2000 French
6,178,965 B1 1/2001 Sulak
6,354,288 B1 3/2002 McDonald

* cited by examiner

*Primary Examiner*—Nathan J. Newhouse
*Assistant Examiner*—Harry Grosso
(74) *Attorney, Agent, or Firm*—Gene Scott; Patent Law Venture Group

(57) ABSTRACT

The present invention is a simulated stone structure having a base with an upfacing planar surface and a continuous groove formed in the surface. A plurality of mutually interlocking wall sections are engaged with the groove to form a continuous wall extending upwardly from the planar surface. The wall sections may be U-shaped with one leg in the groove and the other in contact with the periphery of the base. The wall sections partially overlap each other. s an abutting one of the wall sections. Additional wall sections may be placed atop the first set and interlocked with them. A topper piece may be placed on the additional wall sections for securement thereof.

7 Claims, 3 Drawing Sheets

CLOSED WALL STRUCTURE MOUNTED ON A GROOVED BASE

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to stone and masonry constructions and more particularly to for the king a masonry structure for use as a fire pit, a trash receptacle and similar applications.

2. Description of Related Art

The following art defines the present state of this field:

Jonas, U.S. Des. Pat. No. 201,536 describes a firebox for a self-supported fireplace design.

Paolella, U.S. Pat. No. 2,499,156 describes a fireplace structure comprising a base, a body and a grate-like member, the body being substantially rectangular and having an open top and a lower draft opening in one of the shorter sides, the base being wider than the body and comprising a number of elements arranged crosswise with respect to the body and disposed side by side, the body comprising four layers or courses of blocks of angular formation and the grate-like element being arranged adjacent the juncture of the top course. and the next underlying course and. within a flue provided by the blocks, the lowermost course comprising two identical angular blocks providing a portion of the flue and providing between them the aforesaid draft opening, said draft opening being between opposing angularly set terminal portions of said blocks, the course next above being comprised of two identical angular blocks each having a body portion extending throughout the width of the body of the fireplace and provided with angularly set terminals of unequal length; said terminals.being located at the. longer sides of the fireplace body, and the remaining courses of the body comprising blocks. identical with those of the second-mentioned course, the second, third and fourth courses having their blocks arranged so that the meeting edges of the terminals are in staggered relation.

Kreider, U.S. Pat. No. 3,339,540 describes a portable pre-cast fireplace, which includes: (a) a base of noncombustible material through which a horizontal cool air passage extends that develops at the rear end thereof into an upwardly extending passage; (b) a pre-cast shell of light-weight concrete of low heat conductivity and high temperature resistance that rests on said base, and in, the forward portion of which shell a symmetrical fireplace opening is formed, with the for tht king upper portion of said shell developing into a tubular neck that can be connected to a flue pipe; (c) a transversely positioned metallic firewall disposed in said shell that divides the interior thereof into a rear confined space that is in communication with said upwardly extending passage in said base and at least one warm air discharge opening formed in the upper rear portion of said shell, with the forward portion of said divided shell being utilized for the consumption of fuel; (d) two abutting doors that fit within the confines of said fireplace opening; (e) means for so movably supporting each of said doors that they can first be withdrawn from said opening and then pivoted in a direction to permit access to the interior of said shell; (f) a grate supported from said firewall in said forward portion of said shell; and (g) a damper adjustably supported from said firewall in said forward portion of said shell for regulating the draft to which fuel burning on said grate is subjected, which burning fuel heats said firewall to in turn heat said cool air entering said confined space from said passage, with the, sir heated in said confined space rising to pass from said warm air discharge opening, with said cool air as it rises and is heated. in said confined space. serving to absorb substantially-all the heat radiated thereto by said firewall and by so doing preventing any substantial heating of said shell rearwardly of said firewall.

Szentkuti, U.S. Pat. No. 3,557,770 describes a plurality of building blocks that are arranged in a nonpermanent combination forming a fireplace. A motorless coupling is used to secure various levels or courses of the blocks in a nonadhesive or nonpermanent manner. The configuaration of building blocks forms an ash or draft pit and a fire chamber. A fuel supporting grid is suspended in the fire chamber and a flame diffusing grid is suspended above the fuel supported grid. A grill is supported above the flame diffusing grid. Table blocks are supported on grid supporting rods on both sides of the mortarless masonry fireplace.

Shumock, U.S. Pat. No. 5,186,161 describes a modular fireplace construction utilizing interlocking corner joints in -the fire block area to provide a stable, free-standing base for the smoke chamber and chimney sections above. Individual sections are cast from an extremely heat resistant composition containing Luminate cement and Perlite aggregate. The completed fireplace does not require the addition of a flue liner. Dowel apertures may be formed in the individual sections which receive handling dowels to enable assemblers to easily lift and accurately place the sections during assembly.

Whalen et al., U.S. Pat. No. 5,596,980 describes a portable fireplace for burning combustible materials including a base member defining a fire chamber adapted to receive and contain the materials to be burned. One or more screen members are adapted to extend upwardly from the base member and to protect against burning embers being expelled from the fireplace. A cover member is supported above the screen members and is removable to provide access to the fire chamber when desired. A support structure is associated with the base member to support the base member at a sufficient height above a support surface to prevent the burning or scorching of the support surface. One or more of the screen members is selectively removable to provide access to the fire for enhanced viewing or cooking.

Hodge et al., U.S. Pat. No. 6,024,085 describes a modular fireplace having a first side wall, a second side wall, and a back wall that is contiguous with the first side wall and the second side wall and defines an interior open-faced firebox region having a substantially "U" shape in top plan view. The first side wall is constructed from a plurality of sequentially stacked modular first side blocks and the second side wall is formed from a plurality of sequentially stacked modular second side blocks. The back wall has a first modular corner block, a second modular corner block, and at least one substantially vertical spacer block that are joined so that the first corner block and the second corner block are contiguous with the spacer block. To aid in the efficient drafting of the fireplace, each of the spacer blocks may have a spacer block air chamber extending therein from an open upper end on the spacer block top end to a closed lower end proximate the spacer block bottom end. Further, the first corner block may have a first corner block air chamber therein extending from an open first corner block upper end on the first corner block top end to a closed first corner block lower end proximate the first corner block bottom end, and the second corner block may have a second corner block air chamber extending therein from an open second corner block upper end on the second corner block top end to a closed second corner block lower end proximate the second corner block bottom end. The modular sections of the modular fireplace are engaged in a nesting relationship that serves to orient the respective modular sections, to provide structural support to the modular sections and the modular chimney, and to provide a physical obstruction to the passage of flame, hot gases, and smoke through the joints of the modular sections when the sections are physically joined and mortared together.

French, U.S. Pat. No. 6,050,256 describes a campfire box forming an enclosure having an open top, a closed bottom floor, and inner and outer side walls extending around the periphery of the enclosure with the inner side walls being of insulating material. One or more layers of fire insulating material cover the floor. The insulating side panels and floor provide a cavity formed of fire insulating material for enclosing combustible material.

Sulak, U.S. Pat. No. 6,178,965 describes separable sections including a base section, a firebox section, and a chimney section forming a free standing fireplace intended for use outdoors. In the assembled operational state the top chimney section fits over an opening through the top of the firebox section which fits, at the bottom, onto the top of the base section. In order to facilitate both transport and storage the sections may be configured so that the overall height and volume is much less than the overall height and volume of the fireplace in an operational state. The inverted chimney section may be largely disposed within the firebox section depending from the top of the same through an opening through the top of the firebox section and the base section then fitted on top of both depending downward exterior to the firebox section. At least one lateral opening to the inside of the firebox is provided for access to the interior and facilitation of viewing of a wood burning fire inside. Such a lateral opening may also be the only draft intake during use. Sheet steel is recommended for construction throughout. A cover, either a fire screen or a door, for each lateral opening is suggested as are locking caster wheels at the bottom of the base section. A grill may be added to facilitate cooking in which case a charcoal grate and provision for ventilation from underneath is also recommended.

McDonald, U.S. Pat. No. 6,354,288 describes a portable fireplace having an inner housing defined by an inner housing wall and forming a flame pit, an outer housing having an outer housing wall, the outer housing and the inner housing being interconnected to one another, the outer housing being in surrounding relationship to the inner housing, at least the majority of the for the king walls of the inner and outer housings being spaced from one another to provide an insulation space and a support disposed in the flame pit for supporting a flame presentation substance.

The prior art teaches fireboxes, outdoor gas fireplaces, masonry fire places, portable fireplaces, a mortarless take-down masonry fireplace, a modular fireplaces, a movable campfire box, a stowable fireplace, but does not teach a masonry fireplace of separable wall sections abutting and interlocking and mounted in a circular groove in a flat base. The present invention fulfills these needs and provides further related advantages as described in the following summary.

SUMMARY OF THE INVENTION

The present invention teaches certain benefits in construction and use which give rise to the for the king objectives described below.

The present invention is a structure having a base with an upfacing planar surface and a continuous groove formed in the surface. A plurality of mutually interlocking wall sections are engaged with the groove to form a continuous wall extending upwardly from the planar surface. The wall sections may be U-shaped with one leg in the groove and the other in contact with the periphery of the base. The wall sections partially overlap each other. s an abutting one of the wall sections. Additional wall sections may be placed atop the first set and interlocked with them. A topper piece may be placed on the additional wall sections.

A primary objective of the present invention is to provide an apparatus and method of use of for the king such apparatus that provides advantages not taught by the prior art.

Another objective is to provide such an invention capable of forming a fire pit.

A further objective is to-provide such an invention capable of forming a trash receptacle.

A still further objective is to provide such an invention capable of being assembled into a stable construction without mortar, and which therefore may be thereafter disassembled and moved to a new location.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
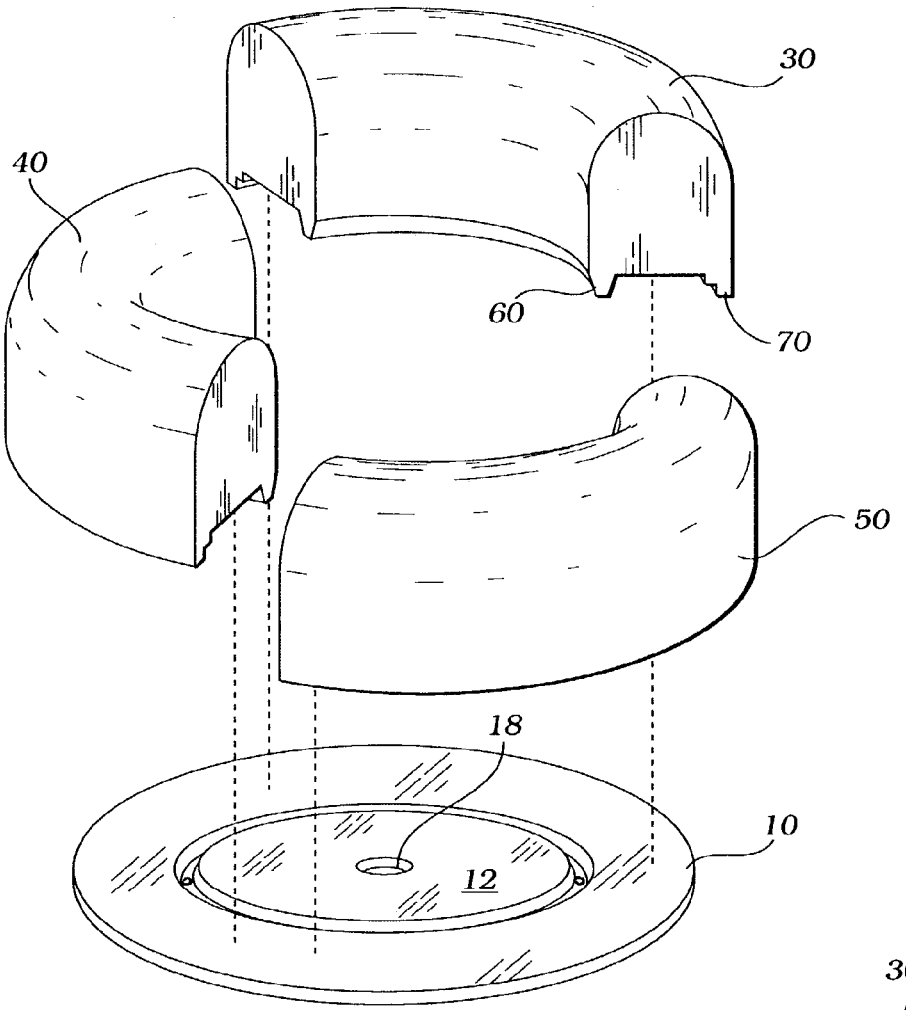
FIG. 1 is an exploded perspective view of a preferred embodiment of the invention.
Figure 2:
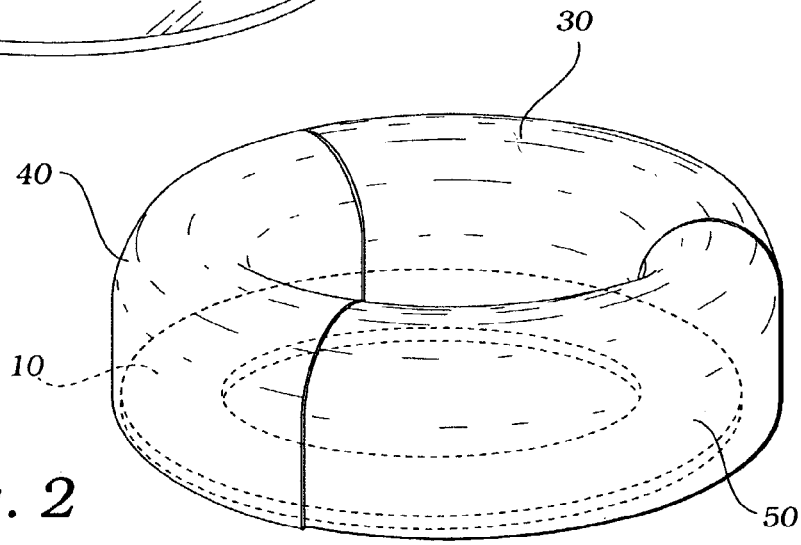
FIG. 2 is a perspective view thereof as assembled into a fire pit configuration.
Figure 3:
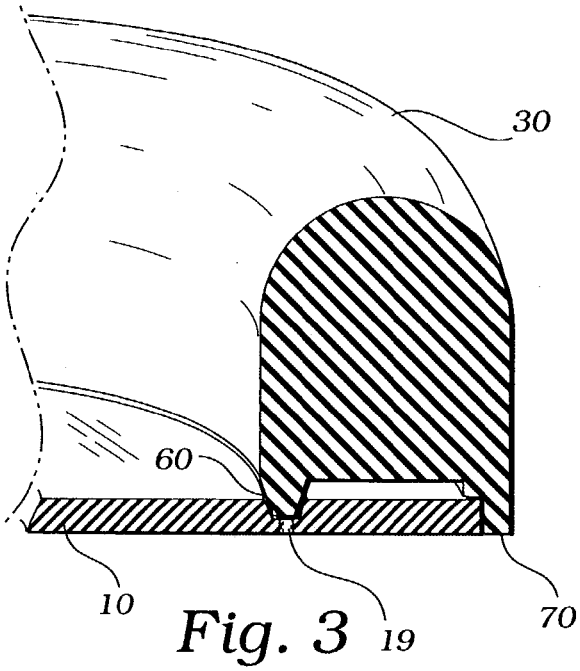
FIGS. 3 and 4 are sectional views thereof taken along line 3—3 in FIG. 2.

The present invention is an apparatus comprising a base 10 and a continuous wall 20 which is mounted on the base 10. The apparatus is made of a masonry product, such as concrete; preferably one of a commercially available very light-weight concrete-like products well known in the art, and is easily assembled by an untrained user; disassembled and moved to a new location and reassembled once again, as desired. The several parts of the invention may be formed to appear to be stone, slate, ceramic, marble and other types of natural materials. The base 10 is preferably disc shaped, as shown in FIG. 1, having an upfacing planar surface 12 with a continuous base groove 14 formed in the surface 12, preferably circular in shape, but may be oval, square, etc. Also, the overall shape of the base 10 may be round, oval, square or other shapes. The base 10 is placed onto a flat surface such as in a garden, on the sands of a beach, etc. The continuous wall 20 is comprised of a first plurality, preferably three or four, of mutually interlocking wall sections 30–50 which are engaged with the continuous base groove 14 to form a continuous wall structure, which extends upwardly from the planar surface 12 and forms a closed figure; round, oval, square, etc. as shown in FIG. 2. Here, it is shown that the sections 30–50 may merely abut without interlocking.

Figure 4:
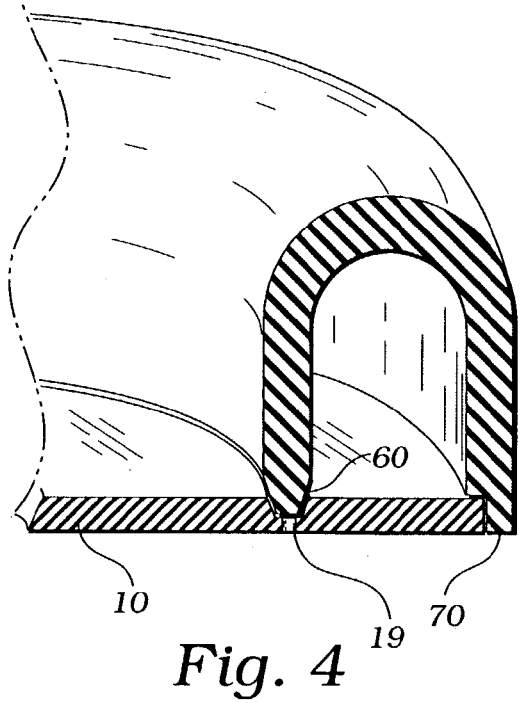
Figure 5:
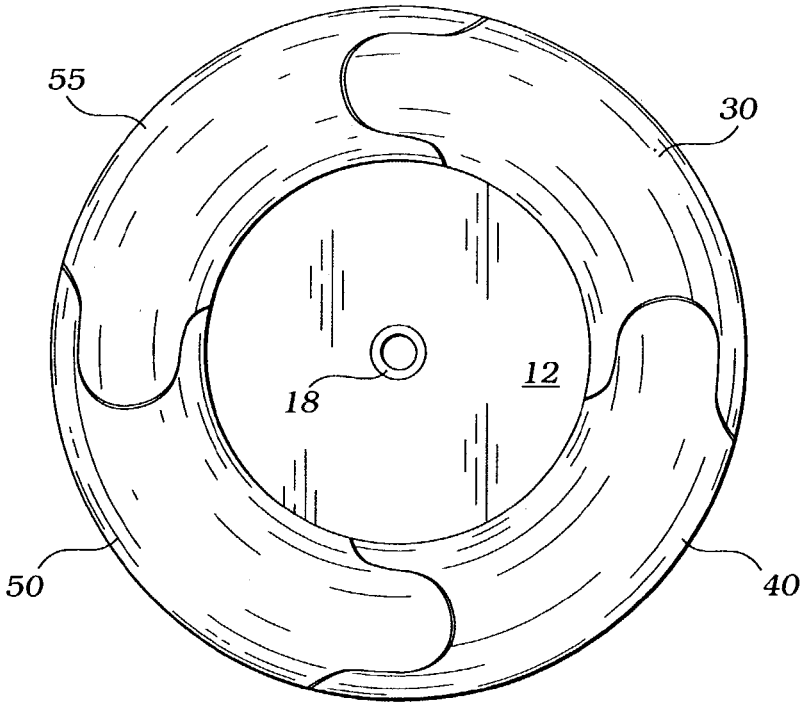
FIG. 5 is a top plan view of a modified enablement thereof.

In a preferred embodiment of the present invention, the wall sections 30–50 are U-shaped, as best seen in FIG. 4, defining a pair of spaced-apart leg terminations 60, 70 wherein one of the leg terminations 60 engages the continuous groove 14 and the other of the leg terminations 70 engages a peripheral outside edge 16 of the base 10. In this manner, the sections 30–50 are guided into preferred positions and are of such size as to abut each other end to end. The groove 14 prevents the sections 30–50 from moving radially inwardly or outwardly so that a fire inside the wall is enclosed. Preferably, each of the wall sections 30–50 partially overlaps or mutually engages the other wall sections 30–50 at the abutting ends, as seen in FIG. 5, so as to form a more sturdy structure, further prevented from moving out of place during use of the apparatus. The base 10 provides a central drain hole 18 so that rain water will not accumulate within the wall 20. Additionally, one or more groove drain holes 19 are positioned within the groove 14 to avoid water accumulation therein.

Figure 6:
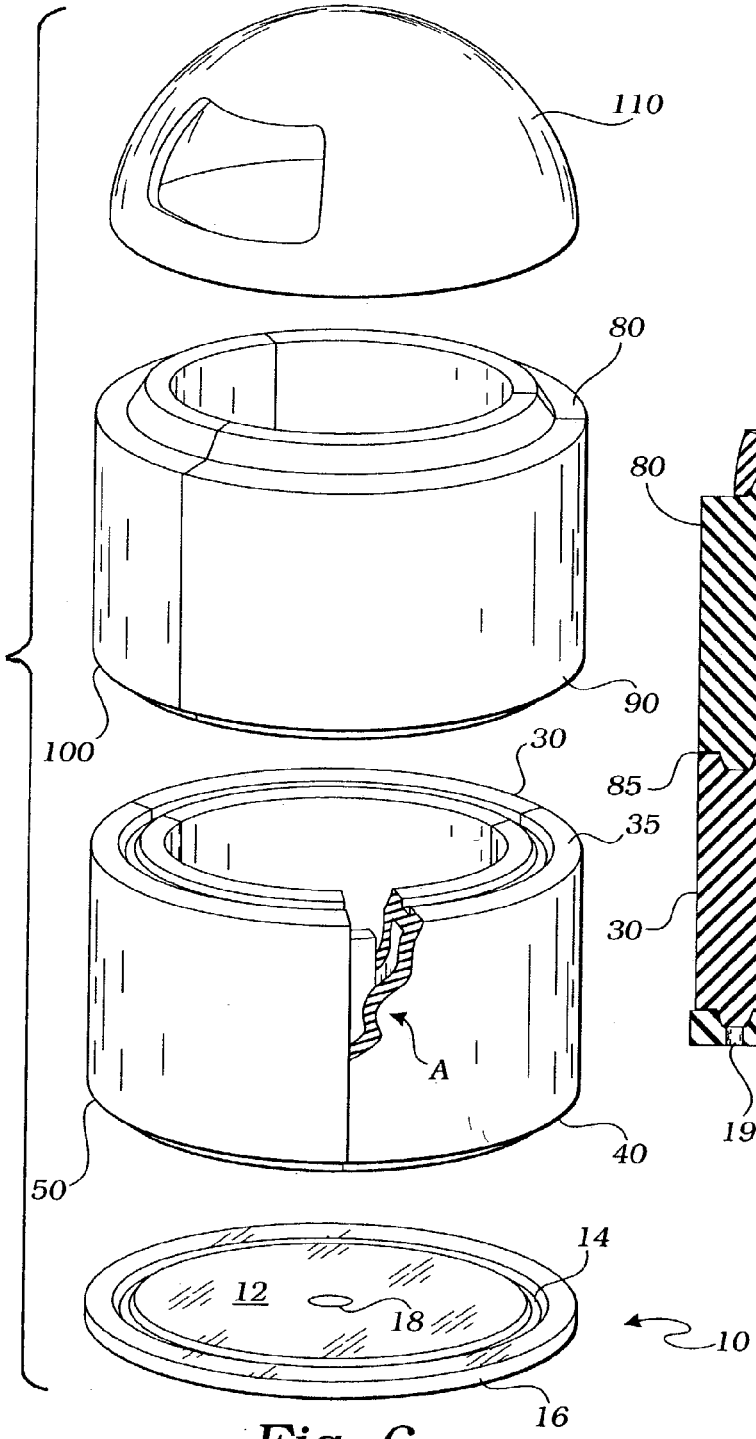
FIG. 6 is an exploded view of a further preferred embodiment of the invention with a portion broken away to reveal underlying detail.
Figure 7:
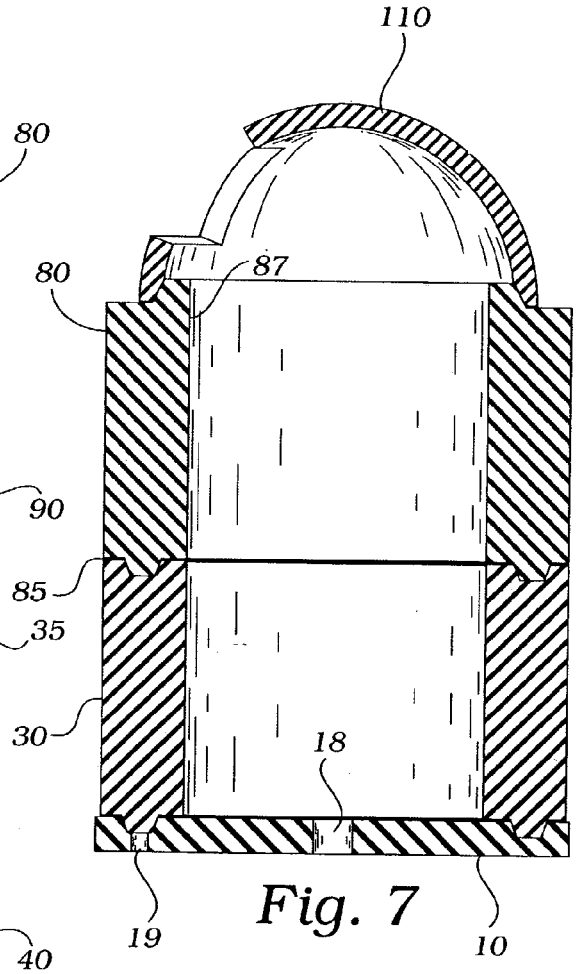
FIG. 7 is a sectional view thereof as assembled and ready for use.

In an alternate embodiment, suitable for use as a trash collecting receptacle, the first wall sections 30–50 each provide an upfacing edge 35. A second plurality of wall sections 80–100 are mounted in interlocking engagement on top of the first wall sections 30–50, as shown in FIG. 7, which, to facilitate support and stability of the arrangement, have an interlocking means 85, as for instance, a tongue in groove enablement between the first 30–50 and the second 80–100 sections. In this embodiment, the first wall sections 30–50 and the second wall sections 80–100 interlock with each other, wherever they abut. The side to side interlocking engagement is shown in FIG. 6 at breakaway :"A." A dome shaped topper portion 110 is positioned in resting engagement on top of the second wall sections 80–100, and preferably, the second wall sections 80–100 provide an upwardly extending flange 87, where the topper portion 110 rests outwardly in surface-to-surface contact with the flange 87. The topper portion 110 therefore provides a restraint to the second wall sections 80–100 to prevent them from moving apart.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus comprising: a base having an upfacing planar surface with a continuous base groove formed therein; a first plurality of mutually interlocking wall sections engaged with the continuous groove to form a continuous wall enclosing the planar surface and extending upwardly from the planar surface; wherein each one of the wall sections is U-shaped defining a pair of spaced-apart leg terminations; one of the leg terminations engaging the continuous groove, the other of the leg terminations engaging a peripheral edge of the base.

2. The apparatus of claim 1 wherein at least one of the wall sections is enabled to partially overlap an abutting one of the wall sections.

3. The apparatus of claim 1 wherein at least one of the wall sections abuts at least one further one of the wall sections in end to end interlocking engagement.

4. The apparatus of claim 1 wherein the base provides at least one drain hole.

5. The apparatus of claim 1 wherein each one of the wall sections provides an upwardly directed edge thereof, and further comprises a second plurality of wall sections mounted in interlocking engagement on top of the first wall sections.

6. The apparatus of claim 5 further comprising a dome shaped topper portion positioned in resting engagement on top of the second wall sections.

7. The apparatus of claim 6 wherein the second wall sections provide an upwardly extending flange, the topper portion resting outwardly thereof in surface-to-surface contact.

* * * * *